US008602812B2

(12) United States Patent
Ohsaka

(10) Patent No.: US 8,602,812 B2
(45) Date of Patent: Dec. 10, 2013

(54) ELECTRICAL CONNECTOR AND ASSEMBLY THEREOF

(75) Inventor: Junji Ohsaka, Machida (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 67 days.

(21) Appl. No.: 13/243,111

(22) Filed: Sep. 23, 2011

(65) Prior Publication Data

US 2012/0100743 A1 Apr. 26, 2012

(30) Foreign Application Priority Data

Oct. 22, 2010 (JP) ..... 2010-237065

(51) Int. Cl.
*H01R 12/24* (2006.01)

(52) U.S. Cl.
USPC ..... 439/497

(58) Field of Classification Search
USPC ..... 439/497, 607.35, 607.41
See application file for complete search history.

(56) References Cited

U.S. PATENT DOCUMENTS 8,043,114 B2 * 10/2011 Kaneko et al. ..... 439/497
8,226,432 B2 * 7/2012 Hsueh et al. ..... 439/497

FOREIGN PATENT DOCUMENTS

JP 3118719 U 2/2006
JP 2009-4117 1/2009
JP 2010-160976 7/2010

* cited by examiner

*Primary Examiner* — Phuong Dinh
(74) *Attorney, Agent, or Firm* — Oblon, Spivak, McClelland, Maier & Neustadt, L.L.P.

(57) ABSTRACT

It is made possible with a simple configuration to electromagnetically shield connection leg portions disposed below a signal transmission medium immediately when both connectors are fitted to each other. A connector main body portion are preliminarily provided with a terminal portion of the signal transmission medium and a transmission-medium-side shield cover that extends from between the another connector (second connector) and the connection leg portions on a transmission-medium side, and the connection leg portions on the transmission-medium side disposed below the signal transmission medium (thin coaxial cables) is covered from above with the transmission-medium-side shield cover when both the connectors are fitted to each other, so that electromagnetic interference (EMI) is successfully prevented from occurring.

4 Claims, 16 Drawing Sheets

ELECTRICAL CONNECTOR AND ASSEMBLY THEREOF

BACKGROUND OF THE INVENTION

1. Field of the Invention

The present invention relates to an electrical connector configured to insert and fit its connector main body portion connected with a terminal portion of a signal transmission medium from the above into another connector mounted on a printed circuit board with connection leg portions joined thereto, and an assembly thereof.

2. Description of the Related Art

Generally, in various electrical devices, a pair of electrical connectors configured to be capable of be connected to each other in a fitting manner is widely used to connect various signal transmission media, such as a plurality of thin coaxial cables or a flexible circuit board, to a printed circuit board. As a pair of electrical connectors used at this time, a plug connector (first connector) connected with a terminal portion of the signal transmission medium and a receptacle connector (second connector) mounted on the printed circuit board are used, where electrical connection is performed by fitting the plug connector into the receptacle connector, for example, as described in Japanese Utility Model Registration No. 3118719, JP-A-2009-4117 (the term "JP-A" as used herein means an "unexamined published Japanese patent application"), and JP-A-2010-160976.

Here, in the electrical connector of a vertically fitting type configured to insert and fit the plug connector (first connector) into the receptacle connector (second connector) from above, connection leg portions of the receptacle connector joined to the printed circuit board may be extended outward from its connector main body and accordingly exposed, which possibly causes electromagnetic interference (EMI). For example, as shown in FIG. 15, in such a configuration where a plug connector X is formed to be smaller in outer shape than a receptacle connector Y so that the fitting of both the connectors X, Y is visible from the above, connection leg portions Y1 of the receptacle connector Y tend to be exposed, and therefore the electromagnetic interference (EMI) is turning into a serious problem along with recent higher-frequency transmission signals.

In view of these circumstances, conventionally, as shown in FIG. 16, a shield cover Z is attached from above so as to cover both the connectors X, Y entirely after fitting, and an end edge portion Z1 of the shield cover Z attached after the connector fitting is extended over the connection leg portions Y1 of the receptacle connector Y to perform electromagnetic shielding. In such a conventional electrical connector, however, it is difficult to dispose the shield cover Z so as to cover the connection leg portions Y1 disposed below terminal portions W1 of a signal transmission medium (thin coaxial cables) W, since the signal transmission medium W becomes an obstacle. Furthermore, since the shield cover Z is formed as a separated part, there is the problem that increase in the number of parts and increase in the number of assembling steps due to attachment of the shield cover Z after the fitting of both the connectors X, Y cause reduction in productivity.

SUMMARY OF THE INVENTION

Therefore, an object of the present invention is to provide an electrical connector with a simple configuration that shields connection leg portions disposed below a signal transmission medium when both connectors are fitted to each other.

In order to achieve the above object, an electronic connector according to the present invention is an electrical connector comprising a connector main body portion provided with a fitting protrusion that is inserted and fitted from above into a fitting recess of another connector mounted on a printed circuit hoard with connection leg portions joined thereto, a terminal portion of the signal transmission medium being connected to the connector main body portion so as to extend above apart from and substantially in parallel to the printed circuit board, and connection leg portions on a transmission-medium side of the another connector being disposed below the terminal portion of the signal transmission medium connected to the connector main body, wherein the connector main body portion is provided with a transmission-medium-side shield cover extending from between the terminal portion of the signal transmission medium and the connection leg portions on the transmission-medium side of the another connector; and the transmission-medium-side shield cover is extended along the connection leg portions of the transmission-medium side of the another connector so as to cover the connection leg portions on the transmission-medium side of the another connector from above.

Further, in order to achieve the above object, an electronic connector assembly according to the present invention is an electrical connector assembly, where a fitting protrusion provided on a connector main body portion of a first connector is inserted and fitted from above into a fitting recess of a second connector mounted on a printed circuit board with connection leg portions joined thereto, a terminal portion of a signal transmission medium is connected to the connector main body portion of the first connector so as to extend above apart from and substantially in parallel to the printed circuit board, and the connection leg portions on a transmission-medium side of the second connector are disposed below the terminal portion of the signal transmission medium connected to the connector main body, wherein the connector main body portion of the first connector is provided with a transmission-medium-side shield cover extending from between the terminal portion of the signal transmission medium and the connection leg portions on the transmission-medium side of the second connector; and the transmission-medium-side shield cover is extended along the connection leg portions on the transmission-medium side of the second connector so as to cover the connection leg portions on the transmission-medium side of the second connector from above.

According to the electrical connector and the assembly thereof thus configured, since the transmission-medium-side shield cover that covers the connection leg portions on the transmission-medium side of the another connector (second connector) from above is preliminarily provided on the connector main body portion, the connection leg portions on the transmission-medium side disposed below the signal transmission medium are covered from above with the transmission-medium-side shield cover at a fitting time of both the connectors, so that electromagnetic interference (EMI) can be successfully prevented from occurring.

Further, in the present invention, the another connector or the second connector is provided with connection leg portions on an anti-transmission-medium side extending from the connector main body portion in the opposite direction of the connection leg portions on the transmission-medium side, and it is desired that the connector main body portion is provided with an anti-transmission-medium-side shield cover that covers the connection leg portions on the anti-transmission-medium side from above.

According to the electrical connector and the assembly thereof thus configured, since the connection leg portions on the anti-transmission-medium side extending in the opposite direction of the terminal portion of the signal transmission medium are covered from above with the anti-transmission-medium-side shield cover when both the connectors are fitted to each other, electromagnetic interference (EMI) can be more successfully prevented from occurring.

Furthermore, for the present invention, it is desired that the transmission-medium-side shield cover and the anti-transmission-medium side shield cover be provided with fitting guide portions that come into contact with an outer surface of the another connector or the second connector in an operation of fitting both the connectors.

According to the electrical connector and the assembly thereof thus configured, since the fitting operation to the another connector or the second connector is performed in a positioned state achieved by the fitting guide portions, the operation of fitting both the connectors to each other is stably performed.

Moreover, for the present invention, it is desired that end edge portions of the transmission-medium-side shield cover and the anti-transmission-medium side shield cover be provided with fitting supporting portions that come into contact with or come close to a surface of the printed circuit board when the operation of fitting both the connectors is completed.

According to the electrical connector and the assembly thereof thus configured, since, when external acting force is applied to the connector main body portion via the terminal portion of the signal transmission medium after the connector fitting operation is completed, the fitting supporting portions of the transmission-medium-side shield cover and the anti-transmission-medium side shield cover come into contact with the surface of the printed circuit board and the external acting force is received by the printed circuit board, so that the strength of the connector main body portion against external force is improved and accordingly good stability of electrical connection is maintained.

Effect of the Invention

As described above, since the electrical connector and the assembly thereof according to the present invention adopts the configuration that successfully prevents occurrence of electromagnetic interference (EMI) by providing the connector main body portion preliminarily with the transmission-medium-side shield cover extending from between the terminal portion of the signal transmission medium and the connection leg portions on the transmission-medium side of the another connector (second connector), and covering the connection leg portions on the transmission-medium side disposed below the signal transmission medium (thin coaxial cables) from above with the transmission-medium-side shield cover when both the connectors are fitted to each other, the connection leg portions disposed below the signal transmission medium can be electromagnetically shielded with the simple configuration immediately when both the connectors are fitted to each other, so that performance or reliability of the electrical connector can be significantly improved at low cost.

DETAILED DESCRIPTION OF THE INVENTION

An embodiment of the present invention applied to an electrical connector that connects a plurality of thin coaxial cables to a printed circuit board will be described below in detail with reference to the drawings.

[A Whole Structure of Electrical Connector Assembly]

First of all, an electrical connector assembly according to an embodiment of the present invention shown in FIGS. 1 to 8 is constituted by a vertically-fitting type connector composed of a plug connector (first connector) 1 connected to terminal portions of thin coaxial cables SC as signal transmission media and a receptacle connector (second connector) 2 into which the plug connector 1 is fitted from above. The receptacle connector 2 included therein is configured to be mounted on a printed circuit board P with connection leg portions joined thereto, and the operation of fitting both the connectors 1, 2 is performed by bringing down the plug connector 1 disposed above the receptacle connector 2 in a downward direction in FIG. 1 that is a direction substantially perpendicular to the printed circuit board P so that a fitting protrusion 1A of the plug connector 1 (see FIGS. 12 and 13) is inserted into a fitting recess 2A (see FIGS. 12 and 13) of the receptacle connector 2. In what follows, a direction in which the plug connector 1 is inserted is defined as "downward direction", and the opposite direction in which the plug connector 1 is drawn out is defined as "upward direction".

[Summary of Connector Main Body Portion]

These plug connector (first connector) 1 and receptacle connector (second connector) 2 have connector main body portions 10, 20 formed in an elongated shape. In what follows, a longitudinal direction of the connector main body portions 10, 20 is called "connector longitudinal direction", and a direction perpendicular to both the connector longitudinal direction and the upward and downward directions described above is called "front-back direction".

Figure 1:
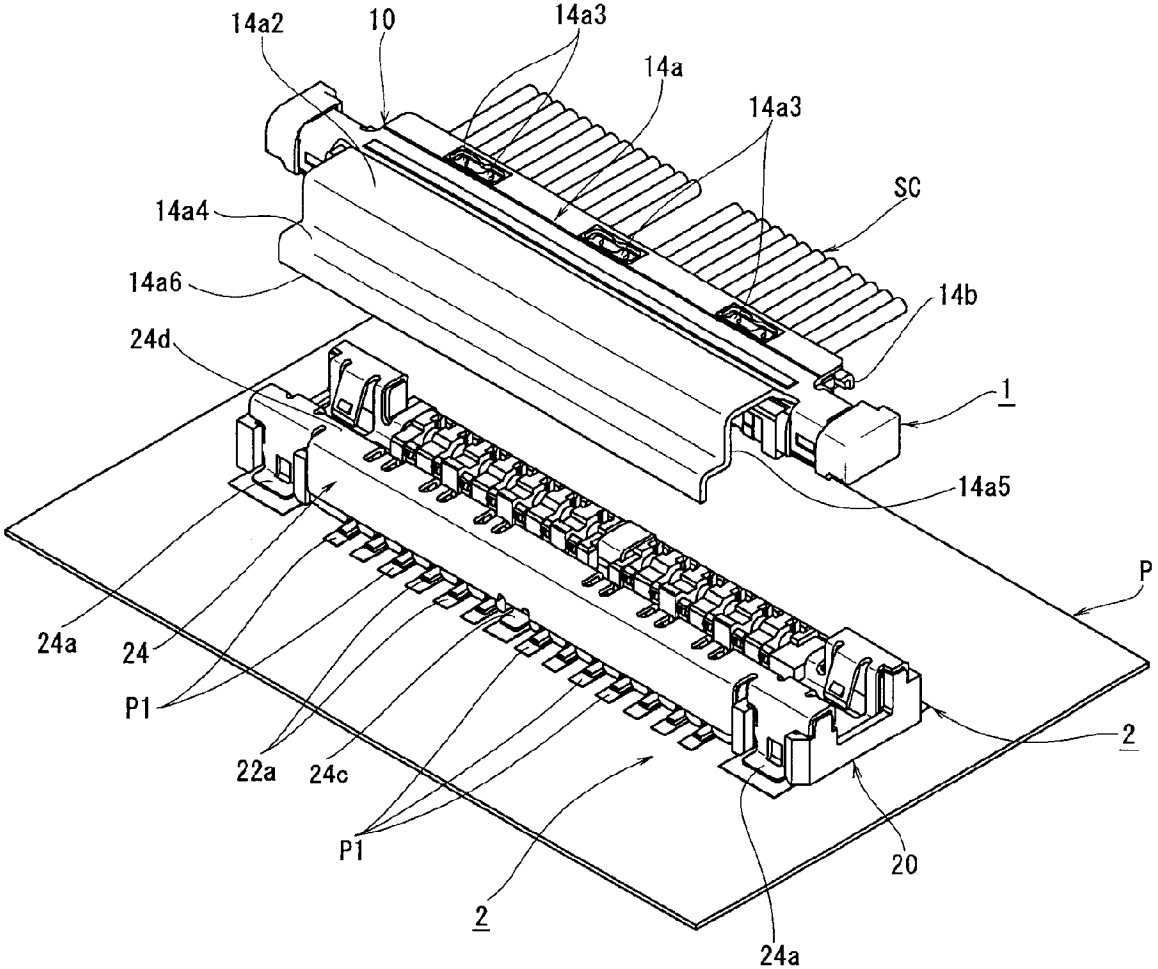
FIG. 1 is a perspective appearance explanatory view showing electrical connectors for thin coaxial cables before fitting according to an embodiment of the present invention viewed from the front.
Figure 2:
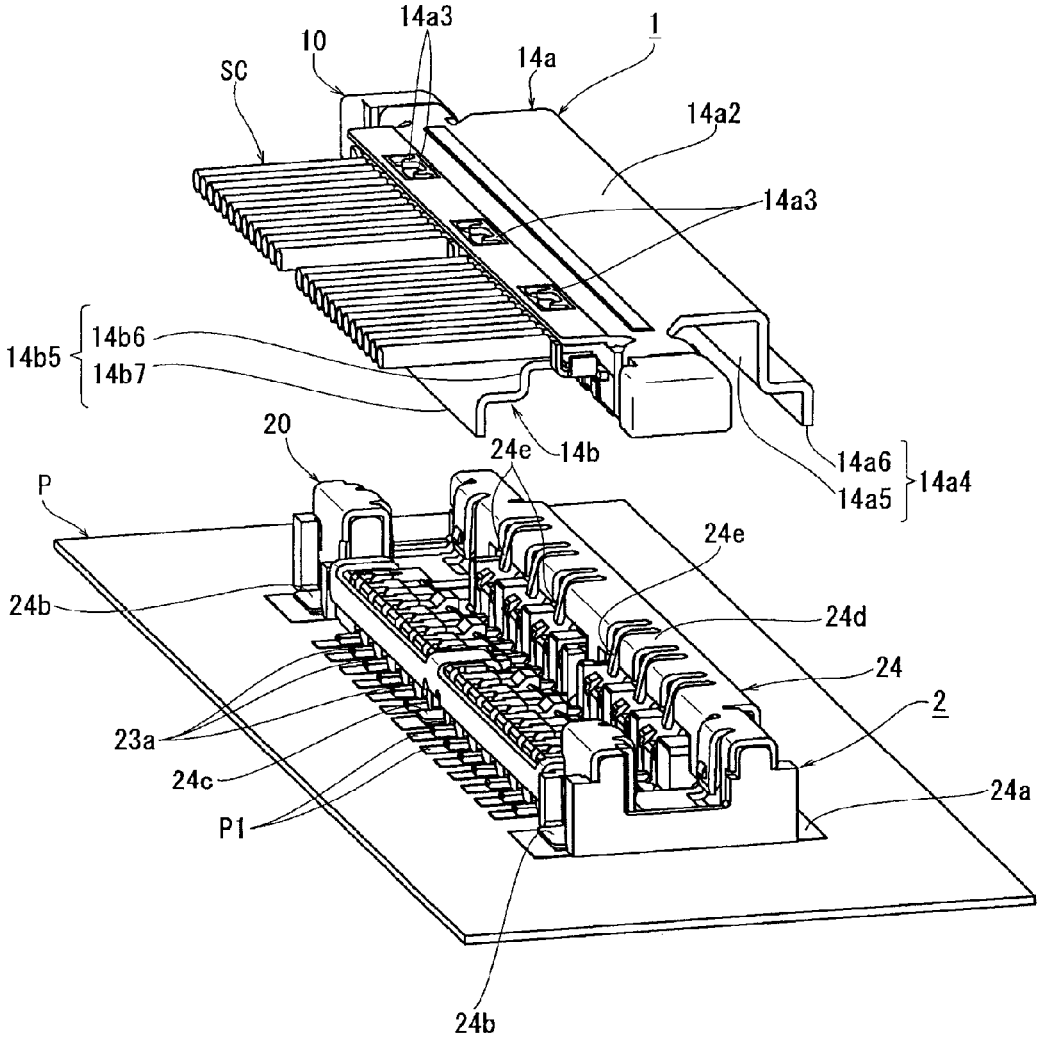
FIG. 2 is a perspective appearance explanatory view showing the electrical connectors according to FIG. 1 viewed from the back.
Figure 3:
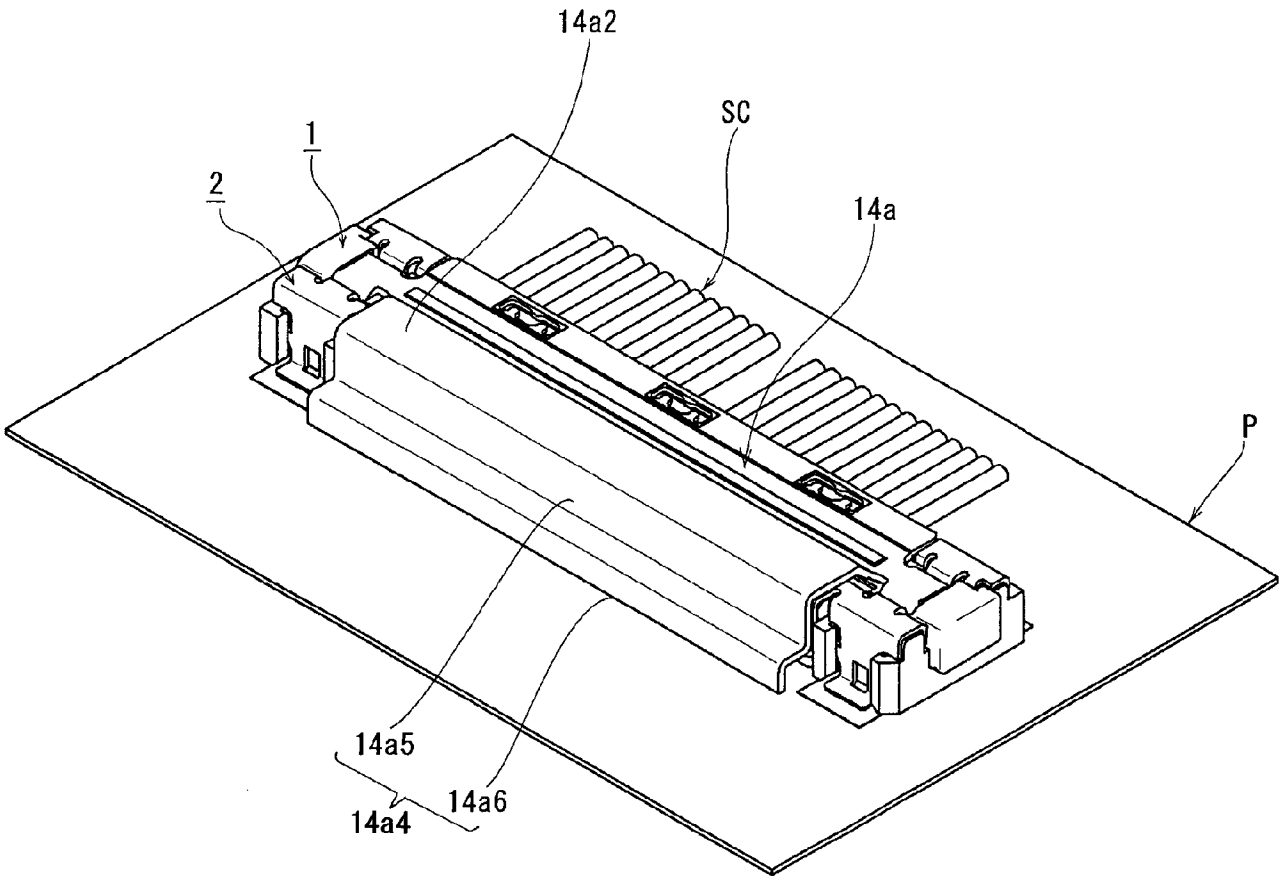
FIG. 3 is a perspective appearance explanatory view showing an electrical connector assembly configured by fitting the electrical connectors shown in FIGS. 1 and 2 to each other viewed from the front.
Figure 4:
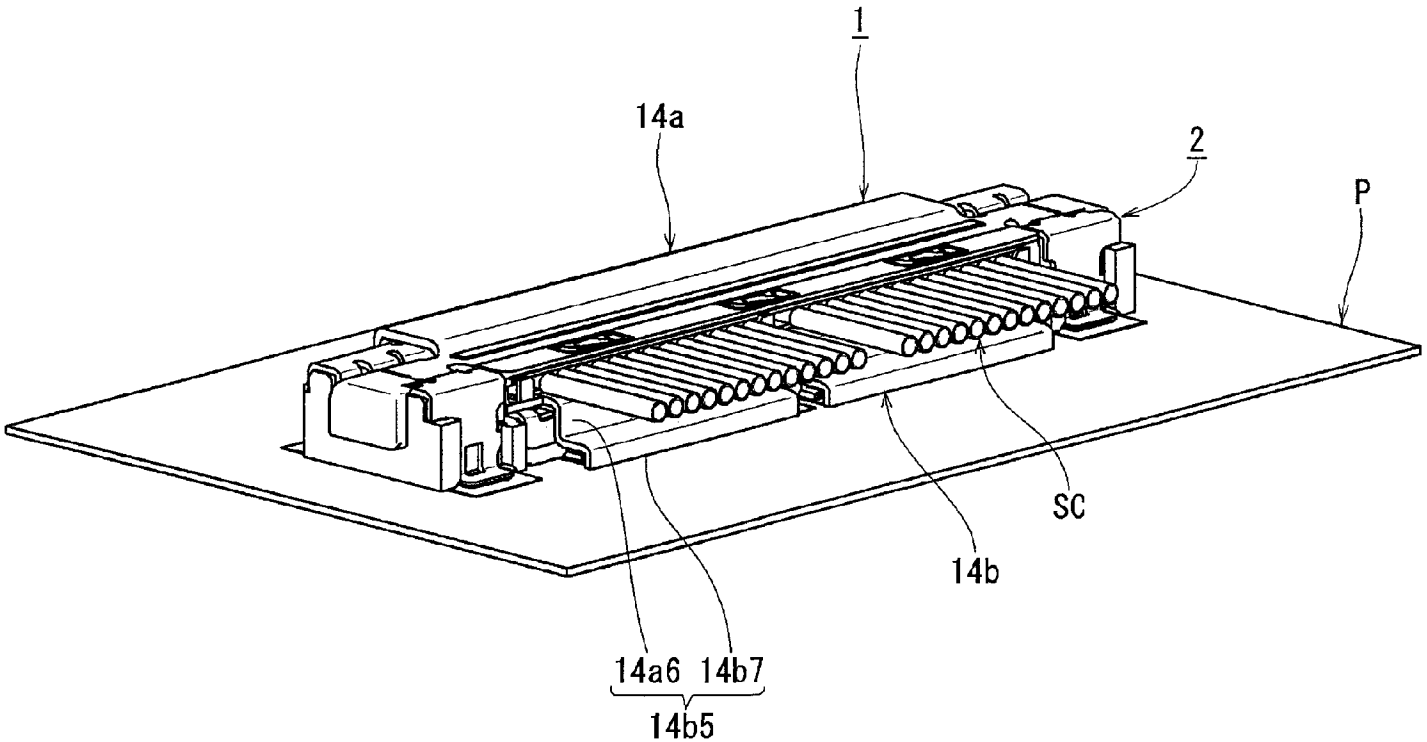
FIG. 4 is a perspective appearance explanatory view showing the electrical connector assembly according to FIG. 3 viewed from the back.
Figure 5:
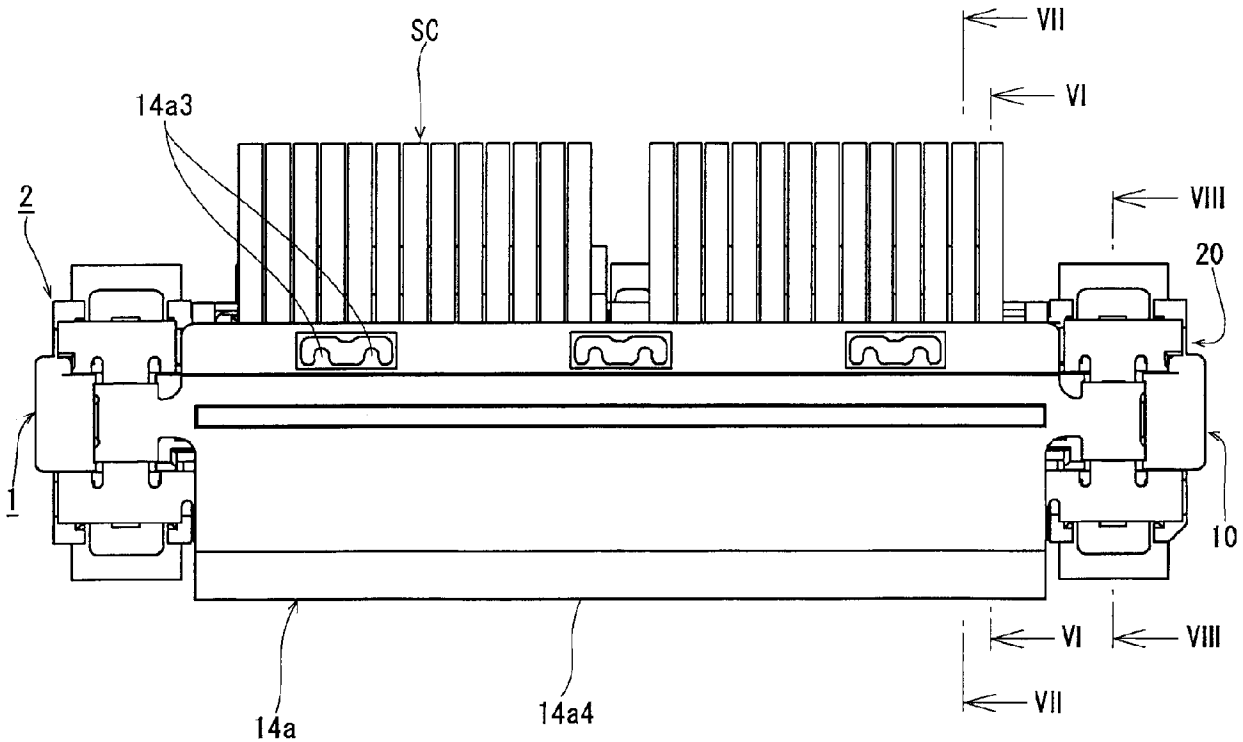
FIG. 5 is a plan explanatory view showing the electrical connector assembly shown in FIGS. 3 and 4 viewed from above.
Figure 6:
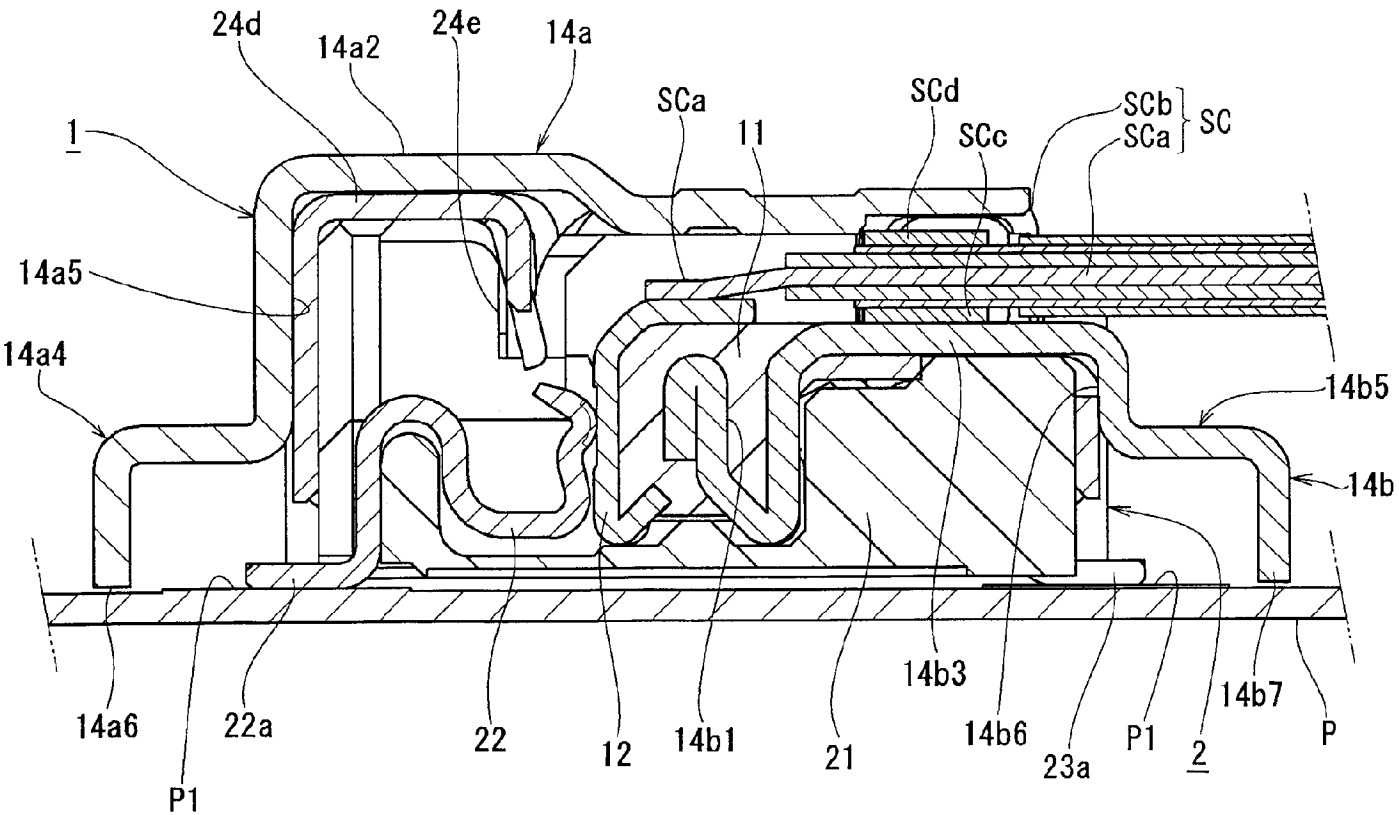
FIG. 6 is a cross-sectional explanatory view taken along line VI-VI in FIG. 5.
Figure 7:
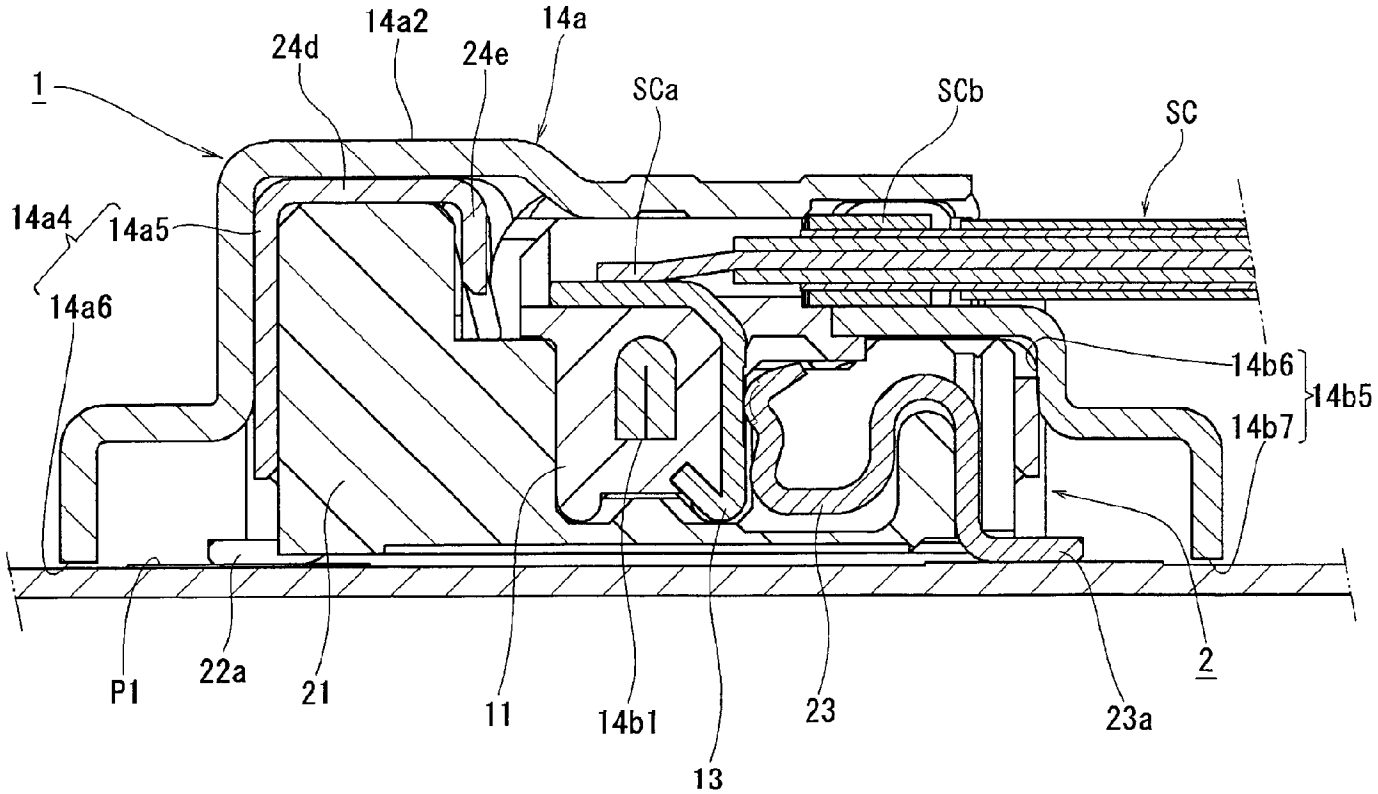
FIG. 7 is a cross-sectional explanatory view taken along line VII-VII in FIG. 5.
Figure 8:
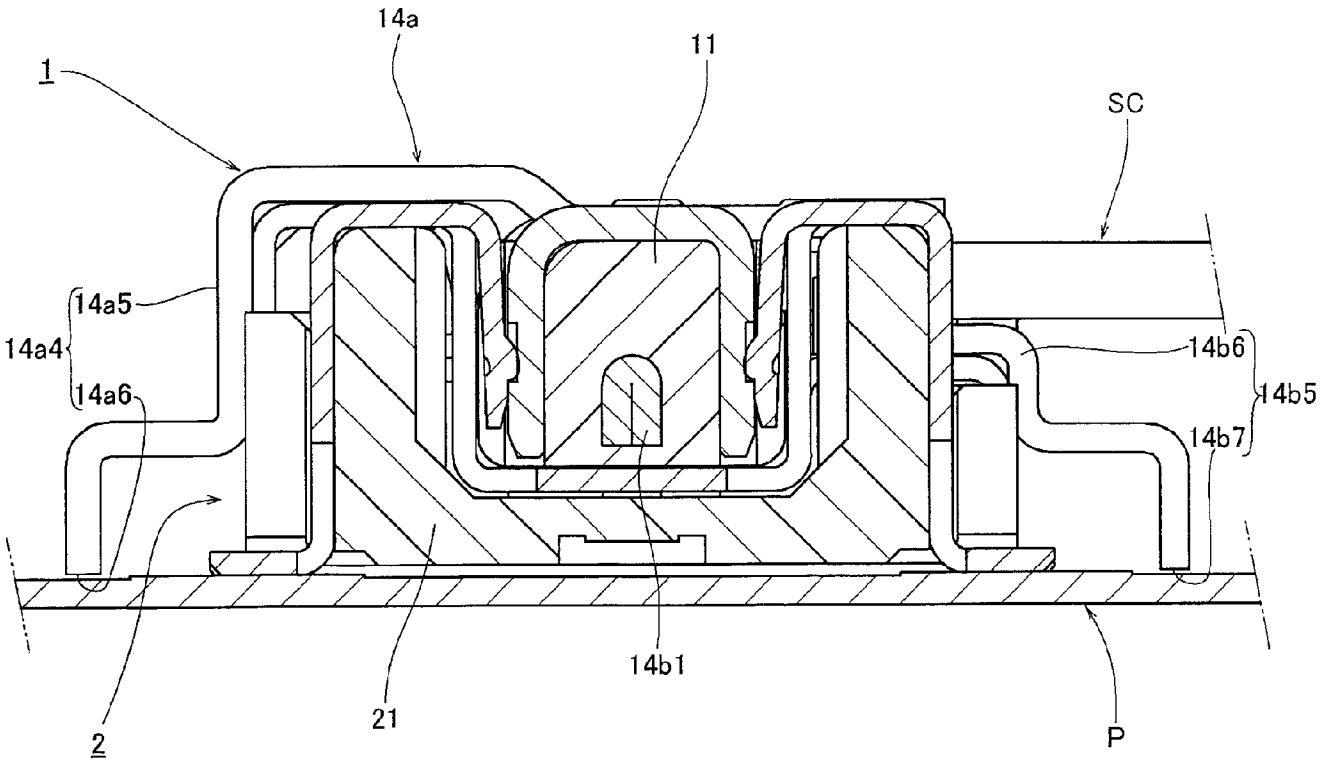
FIG. 8 is a cross-sectional explanatory view taken along line VIII-VIII in FIG. 5.

In insulating housings 11, 21 constituting frame bodies of these connector main body portions 10, 20, a plurality of first conductive terminals (contacts) 12, 22 and a plurality of second conductive terminals (contacts) 13, 23 formed in different shapes from each other are alternately arranged at suitable pitch intervals in the connector longitudinal direction so as to form a multipolar arrangement. After the operation of fitting both these connectors 1, 2 is completed by inserting the plug connector 1 as a first connector downward into the receptacle connector 2 as a second connector, as described above, contact portions of the first conductive terminals (contacts) 12, 22 and contact portions of the second conductive terminals (contacts) 13, 23 provided on both the connectors 1, 2, respectively, come into pressure contact with each other, thereby performing electrical connection, especially as shown in FIG. 6 and FIG. 7.

Further, metal conductive shells 14, 24 also included in the connector main body portions 10, 20 are attached to outer surfaces of the insulating housings 11, 21 described above. The conductive shell 14 of the plug connector (first connector) 1 is attached so as to cover almost an entire surface except for a bottom face having the fitting protrusion 1A (see FIGS. 12 and 13) described above, while the conductive shell 24 of the receptacle connector (second connector) 2 is attached so as to cover peripheral portions except for an upper face having the fitting recess 2A (see FIGS. 12 and 13) described above and a lower face which is a mounting face.

At this time, the fitting protrusion 1A and the fitting recess 2A (see FIGS. 12 and 13) of both the connectors 1, 2 described above are obtained by forming the insulating housings 11, 21 and the conductive shells 14, 24 into a protruded shape and a recessed shape extending in the connector longitudinal direction, and in these protruded portions and recessed portions of the insulating housings 11, 21 and the conductive shells 14, 24, the contact portions of the conductive terminals (contacts)12, 13 and 22, 23 and contact portions of the conductive shells 14, 24 are disposed, so that an electrical and mechanical fitting relationship is formed between both the connectors 1, 2 at the time of fitting.

[Summary of Signal Transmission Medium]

On the other hand, the terminal portions of the thin coaxial cables (signal transmission medium) SC are connected to one end edge portion of the plug connector (first connector) 1 in the front-back direction, and the plurality of thin coaxial cables SC are arranged in the connector longitudinal direction so as to form multipolar shape. In what follows, the elongated end edge portion connected to the terminal portions of the thin coaxial cables SC is called "rear-end edge portion", and the opposite front elongated end edge portion is called "front-end edge portion". Further, respective elongated end edge portions of the receptacle connector 2 that correspond to the "rear-end edge portion" and the "front-end edge portion" of the plug connector 1 are also called "rear-end edge portion" and "front-end edge portion" in the same manner.

In each of the terminal portions of the thin coaxial cables (signal transmission medium) SC, a cable central conductor (signal line) SCa and a cable external conductor (shield line) SCb are exposed by peeling off their cable sheaths. The cable central conductors SCa disposed along the axes of the thin coaxial cables SC are collectively soldered to the respective first and second conductive terminals (contacts) 12, 13 of the plug connector (first connector) 1 described above, and signal transmission circuits are formed by connecting the first and second conductive terminals (contacts) 12, 13 of the plug connector (first connector) 1 to the respective first and second conductive terminals (contacts) 22, 23 of the receptacle connector (second connector) 2, as described later. Note that the respective conductive terminals (contacts) 12, 13 of the plug connector 1 and the thin coaxial cables SC can also be connected by swaging, crimping, or the like.

On the other hand, the cable external conductors SCb disposed around an outer periphery of the cable central conductors SCa are collectively soldered so as to be held between a pair of ground bars SCc, SCd disposed one above the other from above and below. These ground bars SCc, SCd are electrically connected by contact with the conductive shell 14 of the plug connector 1, as described later.

[Shell Structure of Plug Connector]

The conductive shell 14 attached to the plug connector (first connector) 1 is formed by bending a thin-plate-shaped metal member elongated in the connector longitudinal direction into a suitable shape, and configured to cover the plug connector 1 from above almost entirely except for the fitting protrusion 1A, and to cover the electrical connector assembly including the receptacle connector (second connector) 2 from above almost entirely, as described later, after the fitting operation, so that the conductive shell 14 has a preferred structure in obtaining an electromagnetic shielding effect against electromagnetic interference (EMI).

Figure 9:
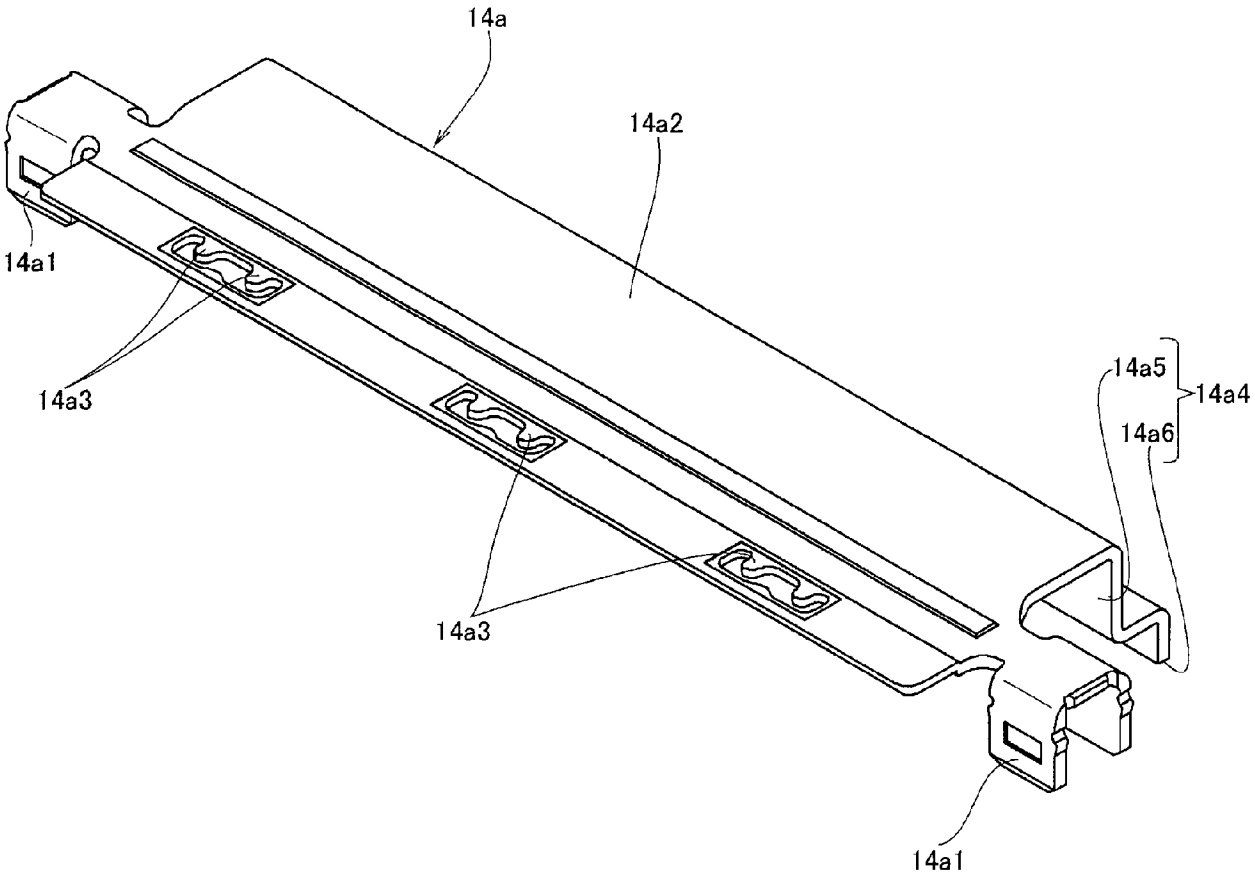
FIG. 9 is a perspective appearance explanatory view showing a structure of a front conductive shell used in a plug connector (first connector) shown in FIGS. 1 to 8 viewed from the back.

The conductive shell 14 is composed of a front conductive shell 14*a* covering a front portion of the plug connector (first connector) 1 and a rear conductive shell 14*b* covering a rear portion of the plug connector 1. The front conductive shell 14*a* has such a shape as shown particularly in FIG. 9, and is attached to the insulating housing 11 from above by press-fitting. Specifically, the conductive shell 14 is fixed to the insulating housing 11 by engagement of insertion fixing portions 14*a*1 provided on both end portions of the front conductive shell 14*a* in the connector longitudinal direction with the insulating housing 11.

Further, a main shell portion 14*a*2 constituting a uppermost face portion of the front conductive shell 14*a* is formed of a substantially flat plate-shaped member extending in the connector longitudinal direction, and a rear-end edge portion of the main shell portion 14*a*2 is provided with a plurality of ground connection tabs 14*a*3 disposed at suitable intervals in the connector longitudinal direction. The respective ground connection tabs 14*a*3 are formed by notching, and melting solder is poured into respective notches, thereby soldering the ground connection tabs 14*a*3 to an upper face of the upper ground bar SCd described above so that a ground circuit is electrically connected. Note that it is possible to form the ground connection tabs 14*a*3 into a cantilever shape having suitable elastic flexibility so as to come into elastic contact with the upper face of the upper ground bar SCd described above so that a ground circuit is electrically connected.

Further, a front-end edge portion of the main shell portion 14*a*2 constituting the front conductive shell 14*a* of the plug connector (first connector) 1 is formed so as to extend substantially flatly, and the flat front-end edge portion of the main shell portion 14*a*2 is configured to come into contact from above with a portion of the receptacle connector (second connector) 2, specifically, a front-end protrusion 24*d* of the conductive shell 24 described later, when the operation of fitting both the connectors 1, 2 is completed, so that the ground circuit is electrically connected between the plug connector 1 and the receptacle connector 2. The main shell portion 14*a*2 constituting the front conductive shell 14*a* of the plug connector 1 is provided with an anti-transmission-medium-side shield cover 14*a*4 extending frontward, that is, in the opposite direction of the thin coaxial cables (signal transmission medium) SC described above. The anti-transmission-medium-side shield cover 14*a*4 is a component of an important portion of the present invention and therefore will be described later in detail.

Figure 10:
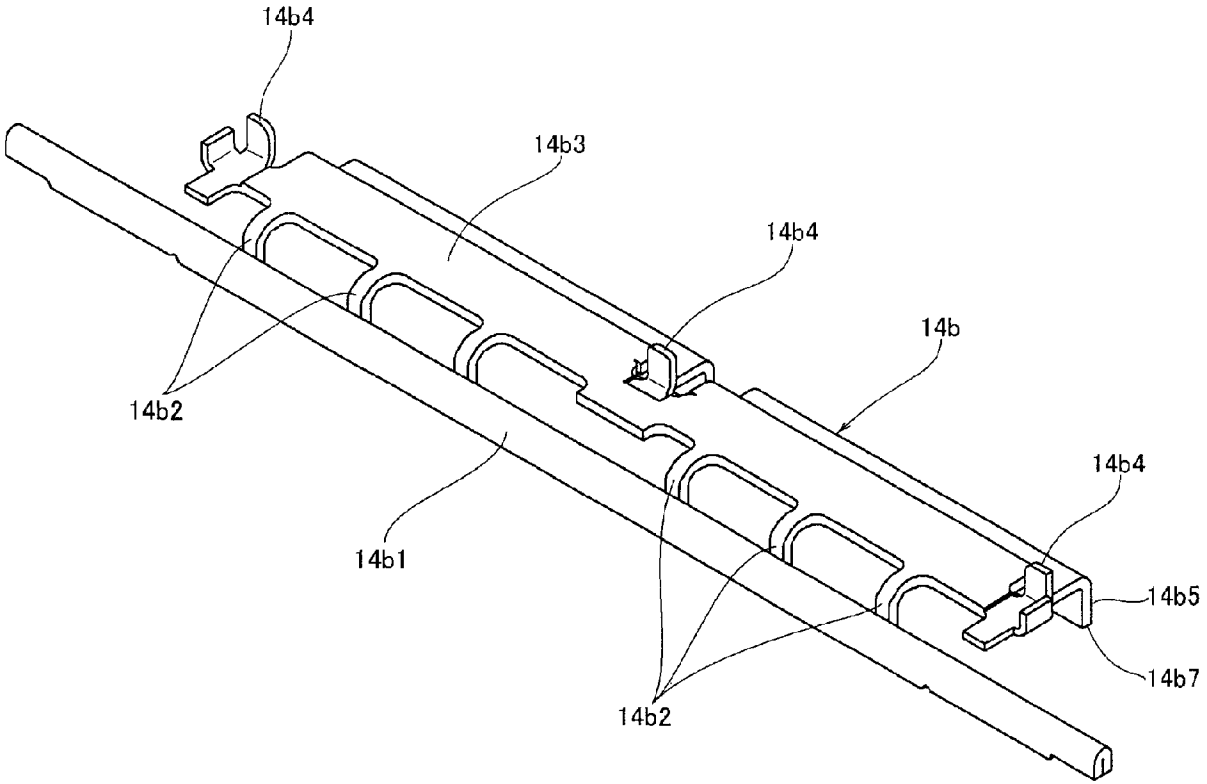
FIG. 10 is a perspective appearance explanatory view showing a structure of a rear conductive shell used in the plug connector (first connector) shown in FIGS. 1 to 8 viewed from the front.
Figure 11:
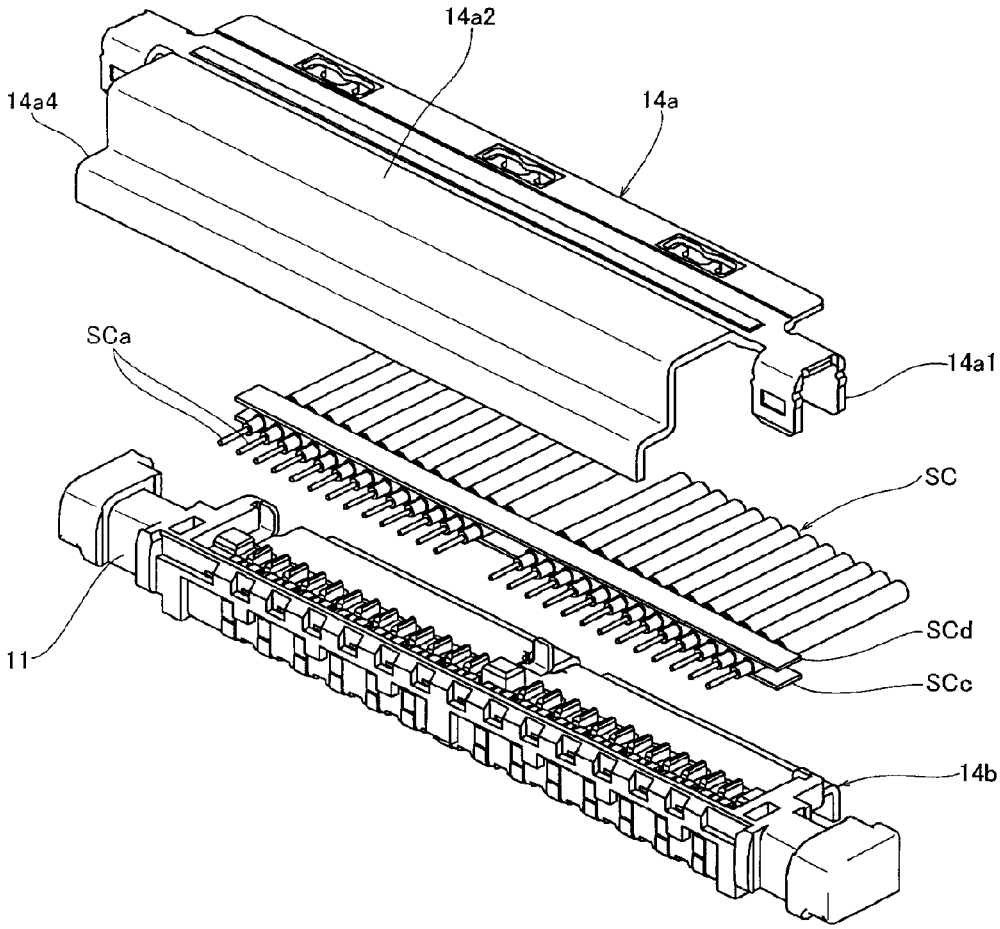
FIG. 11 is an exploded perspective descriptive view showing an assembling process of the plug connector (first connector) shown in FIGS. 1 to 8.

On the other hand, the rear conductive shell 14*b* has such a shape as shown particularly in FIG. 10, and includes an intermediate ground portion 14*b*1 for so-called crosstalk prevention disposed so as to form an elongated bar in the connector longitudinal direction, a plurality of curved connection pieces 14*b*2 extending backward from the intermediate ground portion 14*b*1, and a main shell portion 14*b*3 connected to rear-end portions of the plurality of curved connection pieces 14*b*2. The main shell portion 14*b*3 is formed of a substantially-flat plate-shaped member extending in the connector longitudinal direction, and a front end portion of the main shell portion 14*b*3 is insert-molded to the insulating housing 11 described above along with the intermediate ground portion 14*b*1 and the curved connection pieces 14*b*2, thereby fixing the whole of the rear conductive shell 14*b*.

A rear end portion of the main shell portion 14*b*3 constituting the rear conductive shell 14*b* of the plug connector (first connector) 1 is formed so as to extend horizontally backward from the insulating housing 11, and configured to be disposed so as to contact from below with the lower ground bar SCc described above so that the ground circuit is electrically connected. Note that it is also possible to bring the main shell portion 14*b*3 in direct contact with the respective cable external conductors SCb of the plurality of thin coaxial cables SC, without using the lower ground bar SCc so that the ground circuit is electrically connected. In this case, not only the number of parts can be reduced by saving the lower ground bar SCc, but also a ground circuit resistance associated with each of the plurality of thin coaxial cables SC is reduced by direct connection between the cable external conductors SCb and the main shell portion 14*b*3, so that a good grounding property can be obtained.

Further, transmission medium restricting plates 14*b*4 that position the terminal portions of the thin coaxial cables SC are formed so as to rise from both end portions and a central portion of the main shell portion 14*b*3 in the connector longitudinal direction. Further, a rear end portion of the main shell portion 14*b*3 is provided with a transmission-medium-side shield cover 14*b*5 extending backward, that is, in the same direction as the thin coaxial cables (signal transmission medium) SC described above, and the transmission-medium-side shield cover 14*b*5 is a component of an important portion of the present invention, and therefore will be described later in detail.

[Shell Structure of Receptacle Connector]

While the plug connector 2 is thus configured as the first connector, the conductive shell 24 provided on the receptacle connector 2 as the second connector described above is disposed so as to extend up to both end edge portions in the connector longitudinal direction along both end portions of the insulating housing 21 in the frontward and backward directions. Both end portions of the conductive shell 24 in the connector longitudinal direction are provided with hold-downs 24*a*, 24*b* formed by bending so as to protrude in the frontward and backward directions, respectively, and hold-downs 24*c* are also formed so as to protrude forward and backward at substantially-central portions of front-end edge portion and rear-end edge portion of the conductive shell 24 in the connector longitudinal direction. By soldering the respective holddowns 24*a*, 24*b*, 24*c* to ground conductive paths (not shown) on the printed circuit board P, electrical connection (ground connection) and fixation of the whole of the receptacle connector 2 are performed.

Further, the conductive shell 24 of the receptacle connector (second connector) 2 described above is provided with a front-end protrusion 24*d* covering a protruded portion formed at the front-end edge portion of the insulating housing 21 from above. The front-end protrusion 24*d* includes elastic connection tabs 24*e* protruding obliquely downward toward the fitting recess 2A (see FIGS. 12 and 13) described above, and these elastic connection tabs 24*e* are arranged by plural numbers at suitable intervals in the connector longitudinal direction. The respective elastic connection tabs 24*e* are formed in a cantilever shape by notching so as to have suitable elastic flexibility, and configured to come into pressure contact with a front-end wall face of the insulating housing 11 of the plug connector (first connector) 1 described above when the operation of fitting both the connectors 1, 2 is completed.

[Connection Leg Portion Structure of Receptacle Connector]

Further, first connection leg portions 22*a* protruding substantially horizontally frontward from the front-end edge portion of the insulating housing 21 are formed at front-end edge portions of one first conductive terminals (contacts) 22 attached to the receptacle connector (second connector) 2, and electrical connection is performed by soldering frontward-protruding portions of the respective first connection leg portions 22*a* to signal conductive paths (not shown) on the printed circuit board P described above, and thus a signal transmission circuit is configured. Note that these first connection leg portions 22*a* are members corresponding to what are called anti-transmission-medium-side connection leg portions in the present invention, since they protrude in the opposite direction (frontward) of the terminal portions of the thin coaxial cables (signal transmission medium) SC described above.

Furthermore, second connection leg portions 23*a* protruding substantially horizontally backward from the rear-end edge portion of the insulating housing 21 are formed at rear-end edge portions of the other second conductive terminals (contacts) 23 attached to the receptacle connector 2, and electrical connection is performed by soldering backward-protruding portions of the respective second connection leg portions 23*a* to signal conductive paths (not shown) on the printed circuit board P, and thus a signal transmission circuit is configured in the same manner. Note that these second connection leg portions 23*a* are members corresponding to what are called transmission-medium-side connection leg portions in the present invention, since they protrude in the same direction (backward) as the terminal portions of the thin coaxial cables (signal transmission medium) SC described above.

[Configuration of Shield Cover]

Here, as described above, the terminal portions of the thin coaxial cables SC as signal transmission media are connected to the insulating housing 11 constituting the connector main body portion 10 of the plug connector (first connector) 1, and the terminal portions of the thin coaxial cables SC are positioned above and slightly apart from a surface of the printed circuit board P, and extend backward in substantially parallel with the surface of the printed circuit board P. Further, an arrangement relationship where the second connection leg portions (transmission-medium-side connection leg portions) 23*a* provided on the second conductive terminals (contacts) 23 of the receptacle connector (second connector) 2 described above extend backward over a suitable distance below the thin coaxial cables (signal transmission medium) SC is adopted.

[Transmission-medium-side Shield Cover]

On the other hand, the rear conductive shell 14*b* of the conductive shell 14 provided on the plug connector (first connector) 1 includes the main shell portion 14*b*3 extending backward in contact with the lower ground bar SCc from below, as described above, and the rear end portion of the main shell portion 14*b*3 is provided with the transmission-medium-side shield cover 14*b*5 protruding backward further. The transmission-medium-side shield cover 14*b*5 is disposed below the terminal portions of the thin coaxial cables (signal transmission media) described above, and disposed above the second connection leg portions 23*a* of the receptacle connector (second connector) 2 so as to extend backward along the second connection leg portions 23*a*, thereby covering externally-exposed portions of the second connection leg portions 23*a* from above.

The transmission-medium-side shield cover 14*b*5 is extended substantially horizontally from the insulating housing 11 of the plug connector (first connector) 1 and then bent down at a substantially right angle so as to serve as a rear fitting guide portion 14*b*6. An arrangement relationship where the rear fitting guide portion 14*b*6 is disposed so as to come externally into face-to-face contact with a rear-end edge face of the conductive shell 24 of the receptacle connector (second connector) 2, so that positioning is performed by the rear fitting guide portion 14*b*6 when the plug connector 1 is fitted into the receptacle connector 2.

Figure 12:
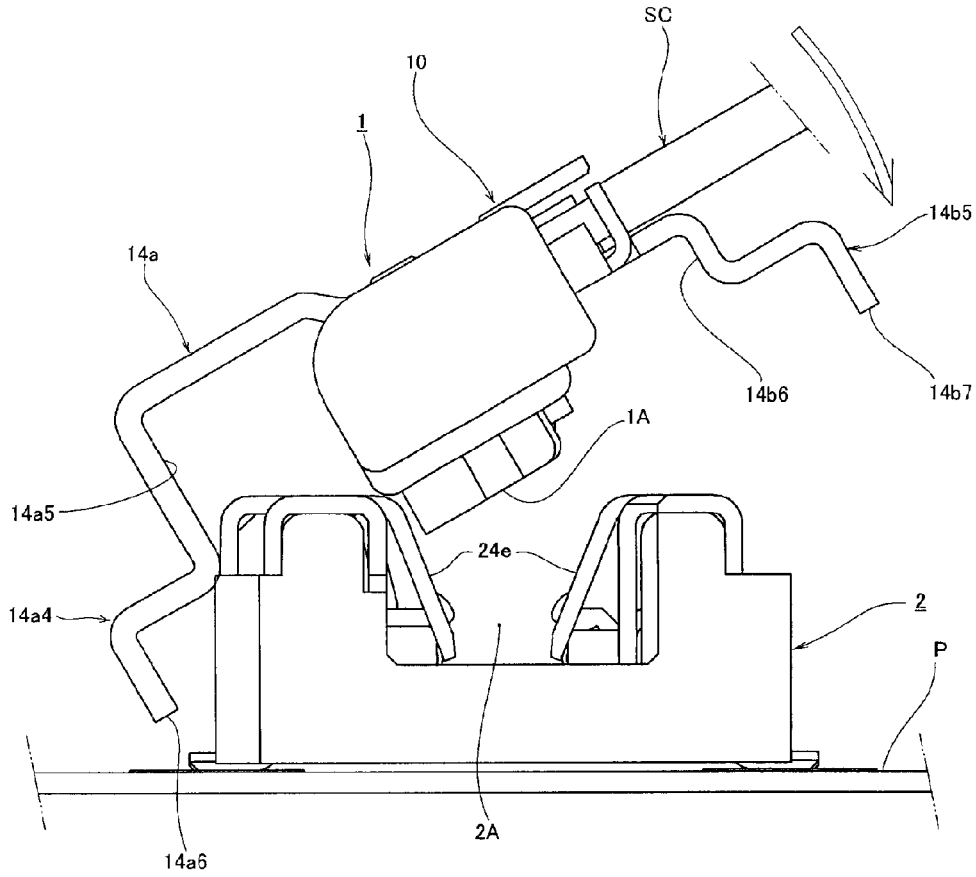
FIG. 12 is a schematic sectional explanatory view showing initiation of a step of fitting the plug connector (first connector) shown in FIGS. 1 to 8 into a receptacle connector (second connector)
Figure 13:
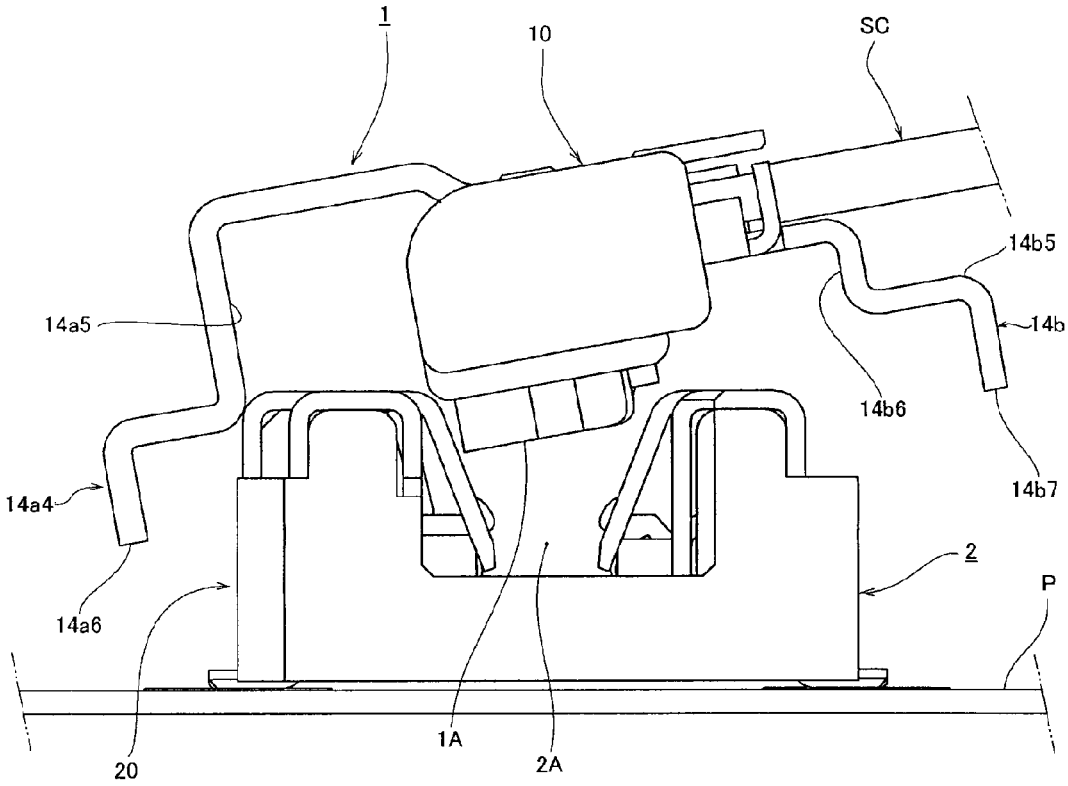
FIG. 13 is a schematic sectional explanatory view showing an advanced state of the fitting operation obtained by pivoting the plug connector (first connector) from the state shown in FIG. 12.
Figure 14:
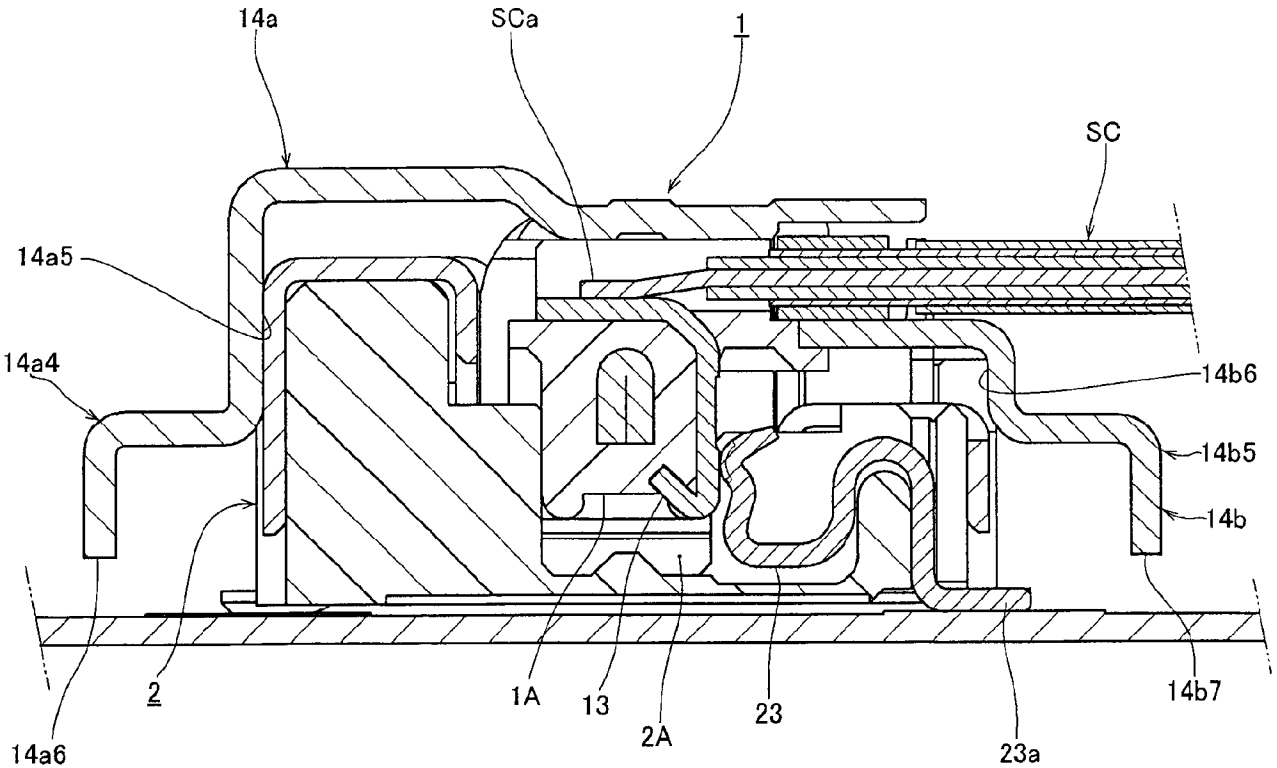
FIG. 14 is a cross-sectional explanatory view showing the plug connector (first connector) put into a substantially-horizontal state by advancing the fitting operation further from the state shown in FIG. 13 and corresponding to FIG. 7.
Figure 15:
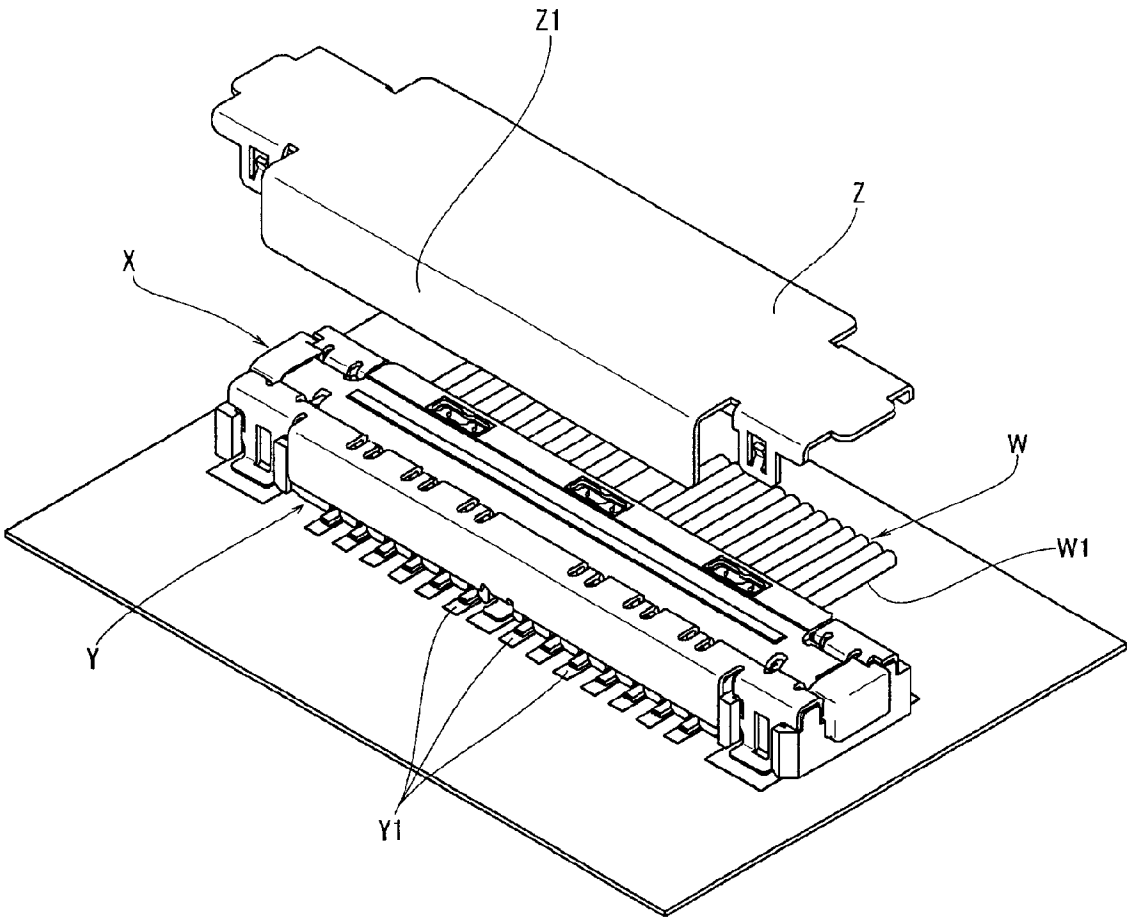
FIG. 15 is a perspective appearance explanatory view showing a conventional electrical connector assembly in the middle of a step of attaching a shield cover to the electrical connector assembly.
Figure 16:
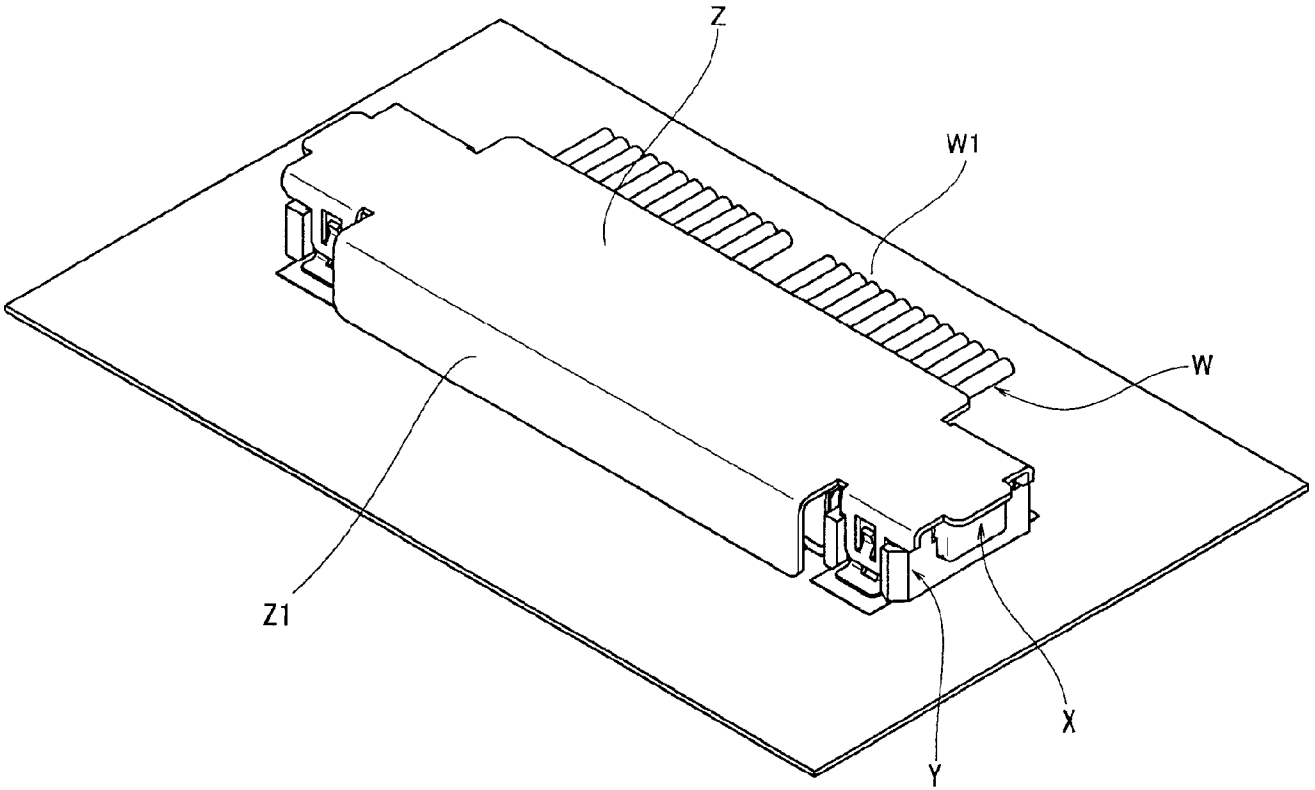
FIG. 16 is a perspective appearance explanatory view showing completion of the attachment of the shield cover to the electrical connector assembly after the state shown in FIG. 15.

By providing the rear fitting guide portion 14*b*6 thus configured on the plug connector (first connector) 1, the operation of fitting the plug connector 1 into the receptacle connector (second connector) 2 is stably performed, as shown in FIG. 12 to FIG. 14 described later.

Further, the transmission-medium-side shield cover 14*b*5 is bent again in a substantially-horizontal direction at a substantially right angle from a lower end edge portion of the rear fitting guide portion 14*a*6 described above, extended backward, and then extended substantially vertically toward the surface of the printed circuit board P so as to bring a distal-end edge portion of the transmission-medium-side shield cover 14*b*5 close to the surface of the printed circuit board P at the time of fitting both the connectors 1, 2. The distal-end edge portion of the transmission-medium-side shield cover 14*b*5 constitutes a fitting supporting portion 14*b*7 having a holding action against external force.

For example, when external acting force is applied to the plug connector (first connector) 1 through the terminal portions of the thin coaxial cables (signal transmission media) SC after the operation of fitting both the connectors 1, 2 is completed, the fitting supporting portion 14*b*7 provided on the distal-end edge portion of the transmission-medium-side shield cover 14*b*5 comes into contact with the surface of the printed circuit board P, and accordingly the external acting force is received by the printed circuit board P, and therefore the strength of the whole of the electrical connector assembly against external force is improved so that good stability of electrical connection is maintained.

Note that the fitting supporting portion 14*b*7 according to this embodiment is disposed close to the surface of the printed circuit board P at the time of fitting both the connectors 1, 2, as described above, but an arrangement relationship can be adopted that the fitting supporting portion 14*b*7 is brought into contact with the surface of the printed circuit board P at that time.

Further, the fitting supporting portion 14*b*7 provided on the distal-end edge portion of the transmission-medium-side shield cover 14*b*5 is formed so as to be positioned behind backward-protruding ends of the second connection leg portions 23*a*, so that the second connection leg portions 23*a*, including land portions P1 formed on the surface of the printed circuit board P, are covered from above with the transmission-medium-side shield cover 14*b*5. Note that surfaces of the signal conductive path (not shown) and the ground conductive path (not shown) on the printed circuit board P are almost entirely covered with insulating material, and portions of the signal conductive path (not shown) and the ground conductive path (not shown) which are formed so as to be exposed on the printed circuit board P are limited to only the land portions P1 to which the second connection leg portions 23*a* are soldered and regions to which the holddowns 24*b*, 24*c* are soldered.

According to such a configuration related to this embodiment, since the connector main body portion 10 is preliminarily provided with the transmission-medium-side shield cover 14*b*5 that covers the second connection leg portions 23*a* of the receptacle connector (second connector) 2 from above, the second connection leg portions 23*a* disposed below the terminal portions of the thin coaxial cables (signal transmission media) SC are covered from above with the transmission-medium-side shield cover 14*b*5 when both the connectors 1, 2 are fitted to each other, so that electromagnetic interference (EMI) is successfully prevented from occurring.

[Anti-Transmission-Medium-Side Shield Cover]

Further, as described above, the main shell portion 14*a*2 of the front conductive shell 14*a* constituting the conductive shell 14 is similarly provided with the anti-transmission-medium-side shield cover 14*a*4 extending frontward. The anti-transmission-medium-side shield cover 14*a*4 is bent down at a substantially right angle from the front-end edge portion of the main shell portion 14*a*2 so as to form a front fitting guide portion 14*a*5. An arrangement relationship where the front fitting guide portion 14*a*5 provided on the plug connector 1 is disposed so as to come externally into face-to-face contact with a front-end edge face of the conductive shell 24 provided on the receptacle connector (second connector) 2 is adopted, so that positioning is performed by the front fitting guide portion 14*a*5 when the plug connector 1 is fitted into the receptacle connector 2.

By providing the front fitting guide portion 14*b*5 thus configured on the plug connector (first connector) 1, the operation of fitting the plug connector 1 into the receptacle connector (second connector) 2 is stably performed. That is, when both the connectors 1, 2 are fitted to each other, positioning in the fitting operation is successfully performed by, first of all, bringing the front fitting guide portion 14*a*5 of the plug connector 1 into contact with the front-end edge portion of the receptacle connector, for example, as shown in FIG. 12, pivoting a rear end portion of the plug connector 1 downward in the direction of arrow about the contact edge so as to be in a state shown in FIG. 13, and finally bringing the rear fitting guide portion 14*b*6 described above into contact with a rear-end edge of the conductive shell 24 of the receptacle connector 2, as shown in FIG. 14. This makes it possible to suppress inclination of the plug connector 1 when the plug connector 1 is fitted into the receptacle connector 2, deformation or breakage of the first conductive terminals 22 and the second conductive terminals 23 due to oblique fitting of the plug connector 1 can be prevented.

Further, the anti-transmission-medium-side shield cover 14*b*4 is bent again in a substantially-horizontal direction at a substantially right angle from a lower end edge portion of the front fitting guide portion 14*a*5 described above, extended frontward, and then extended substantially vertically toward the surface of the printed circuit board P so as to bring a distal end edge portion of the anti-transmission-medium-side shield cover 14*a*4 close to the surface of the printed circuit board P at the time of fitting both the connectors 1, 2. The distal end edge portion of the anti-transmission-medium-side shield cover 14*a*4 constitutes a fitting supporting portion 14*a*6 having a holding action against external force.

For example, when external acting force is applied to the plug connector (first connector) 1 through the terminal portions of the thin coaxial cables (signal transmission media) SC after the operation of fitting both the connectors 1, 2 is completed, the fitting supporting portion 14*b*6 provided on the distal end edge portion of the anti-transmission-medium-side shield cover 14*b*4 comes into contact with the surface of the printed circuit board P, and accordingly the external acting force is received by the printed circuit board P, and therefore the strength of the whole of the electrical connector assembly against external force is improved so that good stability of electrical connection is maintained.

Note that the fitting supporting portions 14*a*6, 14*b*7 according to this embodiment is disposed close to the surface of the printed circuit board P at the time of fitting both the connectors 1, 2, as described above, but such an arrangement relationship can be adopted that the fitting supporting portions 14*a*6, 14*b*7 are brought into contact with the surface of the printed circuit board P at that time.

Further, the fitting supporting portion 14*a*6 provided on the distal end edge portion of the anti-transmission-medium-side shield cover 14*a*4 is formed so as to be positioned behind frontward-protruding ends of the first connection leg portions 22*a*, so that the first connection leg portions 22*a*, including land portions P1 formed on the surface of the printed circuit board P, are covered from above with the anti-transmission-medium-side shield cover 14*a*4. Note that surfaces of the signal conductive path (not shown) and the ground conductive path (not shown) on the printed circuit board P are almost entirely covered with insulating material, and portions of the signal conductive path (not shown) and the ground conductive path (not shown) which are formed so as to be exposed on the surface of the printed circuit board P are limited to only the land portions P1 to which the first connection leg portions 22*a* are soldered and regions to which the holddowns 24*a*, 24*c* are soldered.

According to such a configuration related to this embodiment, since the connector main body portion 10 is preliminarily provided with the anti-transmission-medium-side shield cover 14*a*4 that covers the first connection leg portions 22*a* of the receptacle connector (second connector) 2 from above, the first connection leg portions 22*a* is covered from above with the anti-transmission-medium-side shield cover 14*a*4 when both the connectors 1, 2 are fitted to each other, so that electromagnetic interference (EMI) is successfully prevented from occurring.

The invention which has been made by the present inventors has been specifically described above based on the embodiment, but it goes without saying that the present invention is not limited to the embodiment described above, and can be variously modified without departing from the scope of the present invention.

For example, in the embodiment described above, conductive terminals (contacts) different in shape from each other are alternately disposed, but the present invention is also similarly applicable to an electrical connector where conductive terminals having the same shape are arranged so as to form a multipolar arrangement.

Further, the present invention is not limited to such a connector for thin coaxial cables as in the embodiment described above, and is also similarly applicable to an electrical connector of a type in which a plurality of thin coaxial cables and insulating cables coexist, an electrical connector that connects a flexible circuit board or the like, or the like.

Industrial Applicability

As describe above, the present invention is widely applicable to various electrical connectors used for electrical devices.

What is claimed is:

1. An electrical connector comprising:

a connector main body portion including a fitting protrusion that is inserted and fitted from above into a fitting recess of a receiving connector mounted on a printed circuit board which has first and second connection leg portions soldered thereto, a terminal portion of a signal transmission medium being connected to the connector main body portion and extending above, apart from, and substantially in parallel to the printed circuit board, and the first connection leg portion, which is on a transmission-medium side of the receiving connector, being disposed below the terminal portion of the signal transmission medium, a transmission-medium-side shield cover extending from between the terminal portion of the signal transmission medium and the first connection leg portion, and the transmission-medium-side shield cover extending along the first connection leg portion so as to cover the first connection leg portion from above, and an anti-transmission-medium-side shield cover that covers the second connection leg portion of the receiving connector from above, the second connection leg portion being disposed on an anti-transmission-medium side extending from the connector main body portion in a direction opposite of the first connection leg portion, wherein end edge portions of the transmission-medium-side shield cover and the anti-transmission-medium side shield cover, respectively, include fitting supporting portions that contact or come close to a surface of the printed circuit board in a first position where the electrical connector and the receiving connector are fitted together.

2. The electrical connector according to claim 1, wherein the transmission-medium-side shield cover and the anti-transmission-medium side shield cover respectively, include fitting guide portions that come into contact with an outer surface of the receiving connector in an operation of fitting together the electrical connector and the receiving connector.

3. An electrical connector assembly, comprising:

a first connector including a connector main body having a fitting protrusion thereon;

a second connector including a fitting recess into which the fitting protrusion of the connector main body is inserted and fitted from above, the second connector being mounted on a printed circuit board with first and second connection leg portions joined thereto; and a signal transmission medium having a terminal portion thereof connected to the connector main body portion of the first connector so as to extend above, apart from, and substantially in parallel to the printed circuit board, wherein the first connection leg portion, which is on a transmission-medium side of the second connector is disposed below the terminal portion of the signal transmission medium connected to the connector main body, wherein the connector main body portion of the first connector includes a transmission-medium-side shield cover extending from between the terminal portion of the signal transmission medium and the first connection leg portion, the transmission-medium-side shield cover extending along the first connection leg portion so as to cover the first connection leg portion from above, and an anti-transmission-medium-side shield cover that covers the second connection leg portion of the second connector from above, the second connection leg portion being disposed on an anti-transmission-medium side extending from the connector main body portion in a direction opposite of the first connection leg portion, wherein end edge portions of the transmission-medium-side shield cover and the anti-transmission-medium side shield cover, respectively, include fitting supporting portions that contact or come close to a surface of the printed circuit board in a first position where the first connector and the second connector are fitted together.

4. The electrical connector according to claim 3, wherein the transmission-medium-side shield cover and the anti-transmission-medium side shield cover respectively, include fitting guide portions that come into contact with an outer surface of the second connector in an operation of fitting together the first connector and the second connector.

* * * * *